US007648810B2

(12) United States Patent
Yanus et al.

(10) Patent No.: US 7,648,810 B2
(45) Date of Patent: Jan. 19, 2010

(54) LIQUID INK RESISTANT PHOTORECEPTOR

(75) Inventors: John F. Yanus, Webster, NY (US); Kenny-Tuan T. Dinh, Webster, NY (US); Dale S. Renfer, Webster, NY (US); Nancy L. Belknap, Rochester, NY (US); Anthony M. Horgan, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 299 days.

(21) Appl. No.: 11/531,841

(22) Filed: Sep. 14, 2006

(65) Prior Publication Data

US 2008/0070137 A1 Mar. 20, 2008

(51) Int. Cl.
*G03G 5/047* (2006.01)
*G03G 5/147* (2006.01)

(52) U.S. Cl. ..... 430/59.6; 430/66; 430/132

(58) Field of Classification Search ..... 430/59.6, 430/119.6, 66, 132
See application file for complete search history.

(56) References Cited

U.S. PATENT DOCUMENTS

| | | | | |
|---|---|---|---|---|
| 5,342,718 | A * | 8/1994 | Nousho et al. | 430/59.6 |
| 6,180,303 | B1 * | 1/2001 | Uematsu et al. | 430/59.6 |
| 7,179,573 | B2 * | 2/2007 | Suzuki et al. | 430/66 |
| 2007/0134573 | A1 * | 6/2007 | Yanus et al. | 430/66 |
| 2007/0166634 | A1 * | 7/2007 | Qi et al. | 430/58.7 |

* cited by examiner

*Primary Examiner*—John L Goodrow
(74) *Attorney, Agent, or Firm*—MH2 Technology Law Group LLP

(57) ABSTRACT

An electrophotographic imaging member comprises a substrate, an electrophotographic imaging layer and an overcoat layer comprising a cross-linkable polymer and a hole transport material, wherein the overcoat layer provides at least one of solvent resistance and hydrocarbon resistance to the electrophotographic imaging layer.

19 Claims, 1 Drawing Sheet

FIG. 1
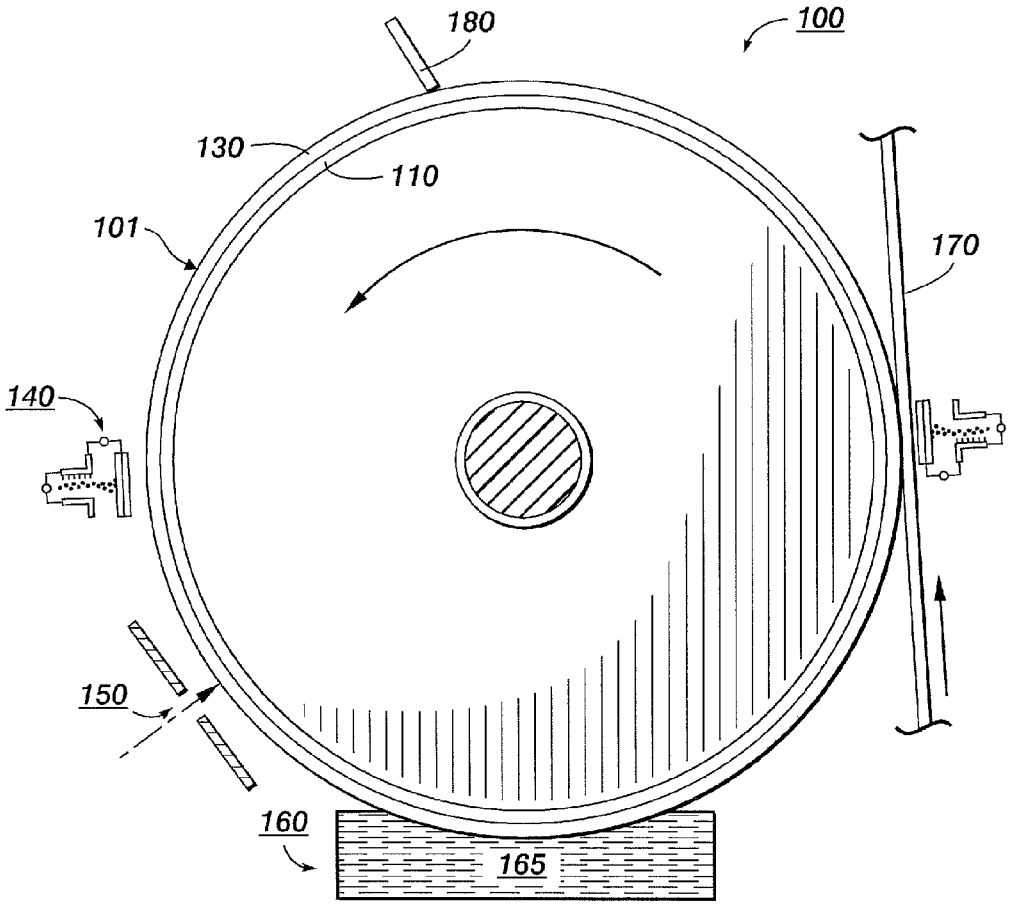
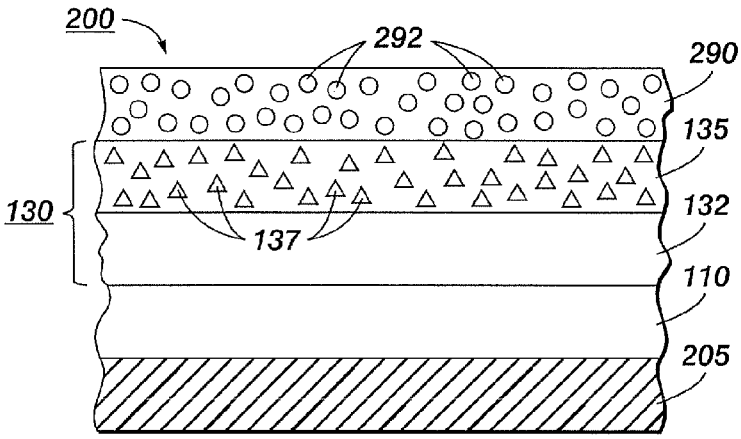
FIG. 2

LIQUID INK RESISTANT PHOTORECEPTOR

FIELD OF THE DISCLOSURE

The subject matter of this disclosure relates to photoreceptors. More particularly, the subject matter of this disclosure relates to an overcoat for photoreceptors that can render the photoreceptors resistant to solvents typically encountered in liquid ink development.

BACKGROUND OF THE DISCLOSURE

Liquid ink development systems offer several advantages over the dry toner development systems. Liquid ink development systems are generally capable of very high image resolution because the toner particles can safely be ten or more times smaller than the dry toner particles. Liquid ink development systems also show impressive grey scale image density response to variations in image charge and achieve high levels of image density using small amounts of liquid developer. Additionally, the systems are usually inexpensive to manufacture and are very reliable.

However, liquid ink development systems are based on volatile liquid carriers or solvents. In conventional liquid development, development of an electrostatic latent image is commonly referred to as electrophoretic development. In liquid development, an insulating liquid carrier having a finely divided solid material dispersed therein contacts the imaging surface in both charged and uncharged areas. Under the influence of the electric field associated with the charged image pattern the suspended particles migrate toward the charged portions of the imaging surface separating out of the insulating liquid. This electrophoretic migration of charged particles results in the deposition of the charged particles on the imaging surface in image configuration. Electrophoretic development of an electrostatic latent image may, for example, be obtained by flowing the developer over the image bearing surface, by immersing the imaging surface in a pool of the developer or by presenting the liquid developer on a smooth surfaced roller and moving the roller against the imaging surface. Hence, in all liquid ink development systems, the imaging surface of the photoreceptor makes contact with the liquid carrier of the toner. This contact of the liquid carrier with the imaging surface or the charge transport layer of the photoreceptor typically causes a problem. The charge transport layer of the photoreceptor invariably contains a charge transport material dissolved in a polymeric binder. When in contact, the liquid carrier of the liquid ink development system causes distinct crystal formation of the charge transport material in the charge transport layer of the photoreceptor. Hence there is a need for photoreceptor which is resistant to the liquid carriers of the liquid ink development system. Currently available photoreceptors which are resistant to the ink are expensive and have limited mechanical and electrical properties.

Thus, there is a need to overcome these and other problems of the prior art to provide a method and system for liquid ink resistant photoreceptors, that have good mechanical and electrical properties.

SUMMARY OF THE DISCLOSURE

In accordance with the disclosure, there is an electrophotographic imaging member comprising a substrate, an electrophotographic imaging layer and an overcoat layer, the overcoat layer comprises a cross-linkable polymer and a hole transport material, wherein the overcoat layer provides at least one of solvent resistance and hydrocarbon resistance to the electrophotographic imaging layer.

According to another embodiment of the present teachings, there is a method for producing an electrophotographic imaging member. The method can comprise providing an exposed receiving surface of an electrophotographic imaging member, wherein the electrophotographic imaging member comprises a substrate and an electrophotographic imaging layer and forming an overcoat layer comprising a hole transport material and at least one of an acrylated polyol film forming resin and a polyester polyol film forming resin, wherein the overcoat layer provides at least one of solvent resistance and hydrocarbon resistance to the electrophotographic imaging layer.

According to yet another embodiment of the present teachings, there is an electrophotographic image development device comprising an electrophotographic imaging member comprising a substrate, an electrophotographic imaging layer, and an overcoat layer. The overcoat layer can comprise a cross-linkable polymer and a hole transport material, wherein the overcoat layer provides at least one of solvent resistance and hydrocarbon resistance to the electrophotographic imaging layer.

Additional advantages of the embodiments will be set forth in part in the description which follows, and in part will be obvious from the description, or may be learned by practice of the disclosure. The advantages will be realized and attained by means of the elements and combinations particularly pointed out in the appended claims.

It is to be understood that both the foregoing general description and the following detailed description are exemplary and explanatory only and are not restrictive of the disclosure, as claimed.

The accompanying drawings, which are incorporated in and constitute a part of this specification, illustrate embodiments of the disclosure and together with the description, serve to explain the principles of the disclosure.

BRIEF DESCRIPTION OF THE DRAWINGS

FIG. 1 is a schematic illustration of an image forming apparatus with a liquid development system.

FIG. 2 illustrates an exemplary electrophotographic imaging member for a liquid development system according to various embodiments of the present disclosure.

DESCRIPTION OF THE EMBODIMENTS

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the disclosure are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can comprise any and all sub-ranges between (and including) the minimum value of zero and the maximum value of 10, that is, any and all sub-ranges having a minimum value of equal to or greater than zero and a maximum value of equal to or less than 10, e.g., 1 to 5.

The term "electrophotographic imaging member" is used interchangeably herein with the terms including "electrophotographic photoreceptor", "image receptor" and "photoreceptor". The term "charge transport material" is used interchangeably herein with the term "hole transport material".

FIG. 1 illustrates an electrophotographic image development device 100 with a liquid development system 160. However, the disclosure is not limited to use in electrophotographic image development devices, but can be used in any suitable liquid development printing system, including but not limited to ionographic systems as well as printing, copying and other systems. The exemplary electrophotographic image development device 100 can comprise a charging station 140 for uniformly charging an electrophotographic imaging member 101. The electrophotographic imaging member 101 can be a drum photoreceptor as shown in FIG. 1 or a belt photoreceptor (not shown here). The electrophotographic imaging member 101 can comprise a conductive layer 110, an electrophotographic imaging layer 130 disposed over the conductive layer 110, and an overcoat layer 290 (not shown in FIG. 1). In various embodiments, the overcoat layer 290 provides at least one of solvent resistance and hydrocarbon resistance to the electrophotographic imaging layer 130. The image forming apparatus 100 can also comprise an imaging station 150 where an original document (not shown) can be exposed to a light source (also not shown) for forming an electrostatic latent image on the surface of the electrophotographic imaging member 101. The image forming apparatus 100 can further comprise a liquid development subsystem 160 for converting the electrostatic latent image to a visible image on the electrophotographic photoreceptor 101. The electrostatic latent image can be developed for example, by flowing the liquid ink developer 165 over the image bearing surface of the electrophotographic imaging member 101, by immersing the image bearing surface of the electrophotographic imaging member 101 in a pool of the liquid ink developer 165, or by presenting the liquid ink developer 165 on a smooth surfaced roller and moving the roller against the image bearing surface of the electrophotographic imaging member 101. The image forming apparatus 100 can also comprise a transfer station 170 for transferring and fixing the visible image onto a paper or other media and a scraping blade 180 for removing the left over toner on the imaging surface 130 of the electrophotographic imaging member 101.

FIG. 2 illustrates an exemplary electrophotographic imaging member 200 according to various embodiments of the present disclosure. The electrophotographic imaging member 200 can comprise a flexible or rigid substrate 205, an electrophotographic imaging layer 130, and an overcoat layer 290 comprising a cross-linkable polymer and a hole transport material 292, wherein the overcoat layer 290 can provide at least one of solvent resistance and hydrocarbon resistance to the electrophotographic imaging layer 130. In various embodiments, the overcoat layer 290 can provide liquid ink resistance to the electrophotgraphic imaging layer 130 in a liquid ink development system. The electrophotographic imaging layer 130 can be a single layer that performs both charge generating and charge transport functions, as is well known in the art, or it can comprise multiple layers such as a charge generation layer 132 and a charge transport layer 135 as shown in FIG. 2. In some embodiments, the electrophotographic imaging member 200 can comprise a conductive layer 110 as shown in FIG. 2 or the substrate can be electrically conductive. In other embodiments, a charge blocking layer (not shown) can be applied to the electrically conductive surface 110 prior to the application of the electrophotographic imaging layer 130. In other embodiments, an adhesive layer (not shown) can be disposed between the charge blocking layer (not shown) and the electrophotographic imaging layer 130. In various embodiments, the charge generation layer 132, can be disposed over the blocking layer (not shown) and a charge transport layer 135 can be formed over the charge generation layer 132. In other embodiments, the charge generation layer 132 can be on top of or below the charge transport layer 135.

The substrate 205 can be opaque or substantially transparent and can comprise any suitable material having the required mechanical properties. Accordingly, the substrate 205 can comprise a layer of an electrically non-conductive or conductive material such as an inorganic or an organic composition. Non-limiting examples of electrically non-conducting materials comprise polyesters, polycarbonates, polyamides, polyurethanes, and the like which are flexible as thin webs. An electrically conducting substrate 205 can be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate 205 can be in the form of an endless flexible belt, a web, a rigid cylinder, a sheet and the like. The thickness of the substrate layer 205 depends on numerous factors, including strength desired and economical considerations. Thus, for a drum, the substrate layer 205 can be of substantial thickness of, for example, up to many centimeters or of a minimum thickness of less than a millimeter. Similarly, a flexible belt can be of substantial thickness, for example, about 250 micrometers, or of minimum thickness less than about 50 micrometers, provided there are no adverse effects on the final electrophotographic device.

In embodiments where the substrate layer 205 is not conductive, the surface thereof can be rendered electrically conductive by an electrically conductive layer 110. The conductive layer 110 can vary in thickness over substantially wide ranges depending upon the optical transparency, degree of flexibility desired, and economic factors. Accordingly, for a flexible electrophotographic imaging member 200, the thickness of the conductive layer 110 can be from about 20 angstroms to about 750 angstroms, and more for example from about 100 angstroms to about 200 angstroms for an optimum combination of electrical conductivity, flexibility and light transmission. The flexible conductive layer 110 can be an electrically conductive metal layer formed, for example, on the substrate 205 by any suitable coating technique, such as a vacuum depositing technique or electrodeposition. Typical metals comprise aluminum, zirconium, niobium, tantalum, vanadium and hafnium, titanium, nickel, stainless steel, chromium, tungsten, molybdenum, and the like.

Referring back to FIG. 2, the electrophotographic imaging member 200 can comprise the electrophotographic imaging layer 130 formed on at least one of adhesive layer, blocking layer, conductive layer 110, or substrate 205. The electrophotographic imaging layer 130 can comprise a charge generation layer 132 disposed over the conductive layer 110 and a charge transport layer 135 disposed over the charge generation layer 132 as shown in FIG. 2. The charge generation layer 132 can comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge generation layer 132 can also comprise inorganic pigments of crystalline selenium and its alloys; Group II-VI compounds;

and organic pigments such as quinacridones, polycyclic pigments such as dibromo anthanthrone pigments, perylene and perinone diamines, polynuclear aromatic quinones, azo pigments including bis-, tris- and tetrakis-azos and the like dispersed in a film forming polymeric binder and fabricated by solvent coating techniques.

The charge generation layer 132 can also comprise photogenerating materials dispersed in a binder. Phthalocyanines have been used as a charge generating material in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and comprise, but are not limited to, oxyvanadium phthalocyanine, chloroaluminum phthalocyanine, copper phthalocyanine, oxytitanium phthalocyanine, chlorogallium phthalocyanine, hydroxygallium phthalocyanine, magnesium phthalocyanine, and metal-free phthalocyanine. The phthalocyanines exist in many crystal forms which have a strong influence on photogeneration.

The binder for the charge generation layer 132 can be any suitable polymeric film forming material. Typical polymeric film forming materials comprise those described, for example, in U.S. Pat. No. 3,121,006, the entire disclosure of which is incorporated herein by reference. Thus, typical organic polymeric film forming binders comprise thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polylmides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers can be block, random or alternating copolymers.

The charge generation layer 132 can have photogenerating material and resinous binder present in various amounts. Generally, however, from about 5 percent by volume to about 90 percent by volume of the photogenerating material can be dispersed in about 10 percent by volume to about 95 percent by volume of the resinous binder, and for example from about 20 percent by volume to about 30 percent by volume of the photogenerating material can be dispersed in about 70 percent by volume to about 80 percent by volume of the resinous binder composition. In some embodiments, about 8 percent by volume of the photogenerating material can be dispersed in about 92 percent by volume of the resinous binder composition. The photogenerator layer 132 can also be fabricated by vacuum sublimation in which case there is no binder.

Any suitable and conventional technique can be utilized to mix and thereafter apply the photogenerating layer coating mixture. Typical application techniques comprise spraying, dip coating, roll coating, wire wound rod coating, vacuum sublimation and the like. For some applications, the charge generating layer 132 can be fabricated in a dot or line pattern. Removing of the solvent of a solvent coated layer can be effected by any suitable conventional technique such as oven drying, infrared radiation drying, air drying and the like.

As shown in FIG. 2, the electrophotographic imaging member 200 can comprise a charge transport layer 135. The charge transport layer 135 can comprise a charge transporting material 137 dissolved or molecularly dispersed in a film forming electrically inert polymer, such as a polycarbonate. As used herein, the term "dissolved" is defined as forming a solution in which the molecule is dissolved in the polymer to form a homogeneous phase. Moreover, the expression "molecularly dispersed" used herein is defined as a charge transporting molecule dispersed in the polymer, the molecules being dispersed in the polymer on a molecular scale. Any suitable charge transporting or electrically active small molecule can be employed in the charge transport layer 135. Furthermore, as used herein, the expression "charge transporting or electrically small molecule" is defined as a monomer that allows the free charge photogenerated in the charge transport layer 135 to be transported across the charge transport layer 135. Typical charge transporting small molecules 137 include, for example, pyrazolines such as 1-phenyl-3-(4'-diethylamino styryl)-5-(4"-diethylamino phenyl)-pyrazoline; diamines such as N,N'-diphenyl-N,N'-bis(3-methylphenyl)-(1,1'-biphenyl)-4,4'-diamine; hydrazones such as N-phenyl-N-methyl-3-(9-ethyl)carbazyl hydrazone and 4-diethyl amino benzaldehyde-1,2-diphenyl hydrazone; and oxadiazoles such as 2,5-bis(4-N,N'-diethylaminophenyl)-1,2,4-oxadiazole; stilbenes and the like. As indicated above, suitable electrically active small molecule charge transporting material 137 can be dissolved or molecularly dispersed in electrically inactive polymeric film forming materials. An example of small molecule charge transporting material 137 that permits injection of holes from the pigment into the charge generation layer 132 with high efficiency and transports them across the charge transport layer 135 with very short transit times is N,N'-diphenyl-N,N'-bis(3-methylphenyl)-(1,1'-biphenyl)-4,4'-diamine. If desired, the charge transport material 137 in the charge transport layer 135 can comprise a polymeric charge transport material or a combination of a small molecule charge transport material and a polymeric charge transport material.

Any suitable electrically inactive polymer or resin that is insoluble in the solvent used to apply the overcoat layer 290 can be employed in the charge transport layer 135. Typical electrically inactive polymer includes, but is not limited to, polycarbonate, polysulfone, polystyrene, and the like. Molecular weights can vary, for example, from about 20,000 to about 150,000. An exemplary electrically inactive polymer for the charge transport layer 135 includes, but is not limited to, polycarbonates such as poly(4,4'-isopropylidene-diphenylene)carbonate (also referred to as bisphenol-A-polycarbonate, poly(4,4'-cyclohexylidinediphenylene) carbonate (referred to as bisphenol-Z polycarbonate), poly(4,4'-isopropylidene-3,3'-dimethyl-diphenyl)carbonate (also referred to as bisphenol-C-polycarbonate) and the like. Any suitable charge transporting polymer can also be utilized in the charge transport layer 135. The charge transport polymer should be insoluble in any solvent employed to apply the subsequent overcoat layer 290 described below, such as an alcohol solvent. These electrically active charge transporting polymeric materials should be capable of supporting the injection of photogenerated charges from the charge generation material and be incapable of allowing the transport of these charges through.

Any suitable and conventional technique can be utilized to mix and thereafter apply the charge transport layer coating mixture to the charge generation layer 132. Typical application techniques comprise spraying, dip coating, roll coating, wire wound rod coating, and the like. Drying of the deposited coating can be effected by any suitable conventional technique such as oven drying, infrared radiation drying, air drying and the like.

Generally, the thickness of the charge transport layer 135 can be from about 10 to about 50 micrometers, but thicknesses outside this range can also be used. The charge transport layer 135 should be an insulator to the extent that the electrostatic charge placed on the charge transport layer 135 is not conducted in the absence of illumination at a rate sufficient to prevent formation and retention of an electrostatic latent image thereon. In general, the ratio of the thickness of the charge transport layer 135 to the charge generator layer 132 can be, for example, maintained from about 2:1 to about 200:1 and in some instances as great as 400:1. The charge transport layer 135, can be substantially non-absorbing to visible light or radiation in the region of intended use but can be electrically "active" in that it allows the injection of photogenerated holes from the charge generation layer 132, and allows these holes to be transported through itself to selectively discharge a surface charge on the surface of the active layer.

According to various embodiments, the electrophotographic imaging member 200 can comprise an overcoat layer 290 comprising a cross-linkable polymer and a hole transport material 292 disposed over the electrophotographic imaging layer 130, wherein the overcoat layer 290 provides at least one of solvent resistance and hydrocarbon resistance to the electrophotographic imaging layer 130. In some embodiments, the overcoat layer 290 can provide liquid ink resistance to the electrophotographic imaging layer 130 in a liquid ink development system. According to various embodiments, the overcoat layer 290 can have a thickness from about 0.1 microns to about 8 microns. In some embodiments, the overcoat layer 290 can also comprise a crosslinking agent. In other embodiments, the overcoat layer 290 can further comprise an acid catalyst.

According to various embodiments, the cross-linkable polymer present in the overcoat layer 290 can comprise at least one of polyester polyol film forming resin and acrylated polyol film forming resin. In other embodiments, the cross-linkable polymer can be any suitable film-forming resin, including any of those described above or in the other layers of the imaging member. In various embodiments, the cross-linkable polymer can be electrically insulating, semi-conductive, or conductive, and can be charge transporting or not charge transporting.

In some embodiments, the cross-linkable polymer can be a polyester polyol, for example a highly branched polyester polyol. As used herein, the expression "highly branched" is defined as a prepolymer synthesized using a significant amount of trifunctional alcohols, such as triols, to form a polymer comprising a significant number of branches off of the main polymer chain. This is distinguished from a linear prepolymer that contains only difunctional monomers, and thus little or no branches off of the main polymer chain. As used herein, the phrase "polyester polyol" is meant to encompass such compounds that include multiple ester groups as well as multiple alcohol (hydroxyl) groups in the molecule, and which can include other groups such as, for example, ether groups and the like. According to various embodiments, the polyester polyol can have a hydroxyl number from about 10 to about 10,000. In various embodiments, the polyester polyol can thus include ether groups, or can be free of ether groups.

Non-limiting examples of suitable polyester polyols include, for example, polyester polyols formed from the reaction of a polycarboxylic acid such as a dicarboxylic acid or a tricarboxylic acid (including acid anhydrides) with a polyol such as a diol or a triol. For example, the number of ester and alcohol groups, and the relative amount and type of polyacid and polyol, can be selected such that the resulting polyester polyol compound retains a number of free hydroxyl groups, which can be used for subsequent crosslinking of the material in forming the overcoat layer 290. Non-limiting examples of polycarboxylic acid include, but are not limited to, adipic acid ($COOH[CH_2]_4COOH$), pimelic acid ($COOH[CH_2]_5COOH$), suberic acid ($COOH[CH_2]_6COOH$), azelaic acid ($COOH[CH_2]_7COOH$), sebasic acid ($COOH[CH_2]_8COOH$), and the like. Suitable polyols include, but are not limited to, difunctional materials such as glycols or trifunctional alcohols such as triols and the like, including propanediol ($HO[CH_2]_3OH$), butanediol ($HO[CH_2]_4OH$), hexanediol ($HO[CH_2]_6OH$), glycerine ($HOCH_2CHOHCH_2OH$), 1,2,6-Hexane triol ($HOCH_2CHOH[CH_2]_4OH$), and the like.

In various embodiments, the suitable polyester polyols can be reaction products of polycarboxylic acids and polyols and can be represented by the following formula (1):

$$[—CH_2—R_a—CH_2]_m—[—CO_2—R_b—CO_2—]_n— \\ [—CH_2—R_c—CH_2]_p—[—CO_2—R_d—CO_2—]_q \quad (1)$$

where $R_a$ and $R_c$ independently represent linear alkyl groups or branched alkyl groups, the alkyl groups having from 1 to about 20 carbon atoms; $R_b$ and $R_d$ independently represent alkyl groups derived from the polycarboxylic acids, the alkyl groups having from 1 to about 20 carbon atoms; and m, n, p, and q represent mole fractions of from 0 to 1, such that n+m+p+q=1.

Non-limiting examples of commercially available suitable polyester polyols include: the DESMOPHEN® series of products available from Bayer Chemical, including the DESMOPHEN® 800, 1110, 1112, 1145, 1150, 1240, 1262, 1381, 1400, 1470, 1630, 2060, 2061, 2062, 3060, 4027, 4028, 404, 4059, 5027, 5028, 5029, 5031, 5035, and 5036 products; the SOVERMOL® series of products available from Cognis Corporation, including the SOVERMOL® 750, 805, 815, 908, 910, and 913 products; and the HYDAGEN® series of products available from Cognis, including the HYDAGEN® HSP product; and mixtures thereof. In exemplary embodiments, DESMOPHEN® 800 and SOVERMOL® 750, or mixtures thereof can be used. DESMOPHEN® 800 is a highly branched polyester bearing hydroxyl groups, having an acid value of ≦4 mg KOH/g, a hydroxyl content of about 8.6±0.3%, and an equivalent weight of about 200. DESMOPHEN® 800 corresponds to the above formula (1) where the polymer comprises 50 parts adipic acid, 10 parts phthalic anhydride, and 40 parts 1,2,6-hexanetriol, where $R_b$=—$[CH_2]_4$—, n=0.5, $R_d$=-1,2-$C_6H_4$—, q=0.1, $R_a$=$R_c$=—$CH_2[CHO—][CH_2]_4$—, and m+p=0.4. DESMOPHEN® 1100 corresponds to the above formula (1) where the polymer comprises 60 parts adipic acid, 40 parts 1,2,6-hexanetriol, and 60 parts 1,4-butanediol, where $R_b$=$R_d$=—$[CH_2]_4$—, n+q=0.375, $R_a$=—$CH_2[CHO—][CH_2]_4$—, m=0.25, $R_c$=—$[CH_2]_4$—, and p=0.375. SOVERMOL® 750 is a branched polyether/polyester/polyol having an acid value of ≦2 mg KOH/g, and a hydroxyl value of 300-330 mg KOH/g.

In other embodiments, the crosslinking polymer can be an acrylated polyol. In some embodiments, the acrylated polyol can have a hydroxyl number from about 10 to about 10,000. Suitable acrylated polyols can be, for example, the reaction products of propylene oxide modified with ethylene oxide, glycols, triglycerol and the like. Such acrylated polyols can be represented by the following formula (2):

$$[R_t—CH_2]_t—[—CH_2—R_a—CH_2]_p—[—CO—R_b—CO—]_n—[—CH_2—R_c—CH_2]_p—[—CO—R_d—CO—]_q \quad (2)$$

where $R_t$ represent $CH_2CR_1CO_2$— where $R_1$=methyl, ethyl, etc., where $R_a$ and $R_c$ independently represent linear alkyl or alkoxy groups or branched alkyl or alkoxy, the alkyl and alkoxy groups having from 1 to about 20 carbon atoms; $R_b$ and $R_d$ independently represent alkyl or alkoxy groups, the alkyl and alkoxy groups having from 1 to about 20 carbon atoms; and m, n, p, and q represent mole fractions of from 0 to 1, such that n+m+p+q=1. Non limiting examples of commercial acrylated polyols are JONCRYL® polymers, available from Johnson Polymers Inc. and POLYCHEM polymers, available from OPC polymers.

In various embodiments, the overcoat layer 290 can also include cross linking agents and/or catalysts. In some embodiments, the crosslinking agent can be a melamine crosslinking agent or accelerator. Incorporation of a crosslinking agent can provide reaction sites to interact with the polyester polyol and/or acrylated polyol, to provide a branched, crosslinked structure. When so incorporated, any suitable crosslinking agent or accelerator can be used, including, for example, trioxane, melamine compounds, and mixtures thereof. Where melamine compounds are used, they can be functionalized to be, for example, melamine formaldehyde, methoxymethylated melamine compounds, such as glycouril-formaldehyde and benzoguanamine-formaldehyde, and the like. In some embodiments, the crosslinking agent can include a methylated, butylated melamine-formaldehyde. A non limiting example of a suitable methoxymethylated melamine compound can be CYMEL® 303 (available from Cytec Industries), which is a methoxymethylated melamine compound with the formula $(CH_3OCH_2)_6N_3C_3N_3$ and the following structure:

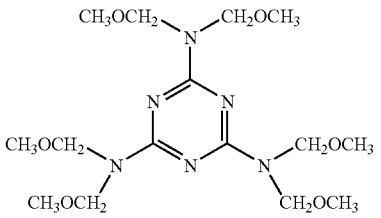

Crosslinking can be accomplished by heating at least one of polyester polyol or acrylated polyol in the presence of a catalyst. Hence, the overcoat layer 290 can also include a catalyst. Non-limiting examples of catalysts include: oxalic acid, maleic acid, carbollylic acid, ascorbic acid, malonic acid, succinic acid, tartaric acid, citric acid, p-toluenesulfonic acid, methanesulfonic acid, and the like and mixtures thereof.

In various embodiments, a blocking agent can also be included in the overcoat layer 290. A blocking agent can be used to "tie up" or block the acid effect to provide solution stability until the acid catalyst function is desired. Thus, for example, the blocking agent can block the acid effect until the solution temperature is raised above a threshold temperature. For example, some blocking agents can be used to block the acid effect until the solution temperature is raised above about 100° C. At that time, the blocking agent dissociates from the acid and vaporizes. The unassociated acid is then free to catalyze the polymerization. Examples of such suitable blocking agents include, but are not limited to, pyridine and commercial acid solutions containing blocking agents such as CYCAT® 4040 available from Cytec Industries Inc.

The temperature used for crosslinking varies with the specific catalyst and heating time utilized and the degree of crosslinking desired. Generally, the degree of crosslinking selected depends upon the desired flexibility of the final photoreceptor. For example, complete crosslinking may be used for rigid drum or plate photoreceptors. However, partial crosslinking is preferred for flexible photoreceptors having, for example, web or belt configurations. The degree of crosslinking can be controlled by the relative amount of catalyst employed. The amount of catalyst to achieve a desired degree of crosslinking will vary depending upon the specific coating solution materials, such as polyester polyol/acrylated polyol, catalyst, temperature and time used for the reaction. In an aspect, the polyester polyol/acrylated polyol is cross linked at a temperature from about 100° C. to about 150° C. A typical cross linking temperature used for polyester polyols/acrylated polyols with p-toluenesulfonic acid as a catalyst is less than about 140° C. for about 40 minutes. A typical concentration of acid catalyst is from about 0.01 to about 5 weight percent based on the weight of polyester polyol/acrylated polyol. After crosslinking, the overcoating should be substantially insoluble in the solvent in which it was soluble prior to crosslinking. Thus, no overcoating material can be removed when rubbed with a cloth soaked in the solvent. Crosslinking results in the development of a three dimensional network which restrains the transport molecule in the crosslinked polymer network.

The overcoat layer 290 can also include a hole transport material 292 to improve the charge transport mobility of the overcoat layer 290. According to various embodiments, the hole transport material 292 can be selected from the group consisting of (i) a phenolic substituted aromatic amine, (ii) a primary alcohol substituted aromatic amine, and (iii) combinations thereof. In various embodiments, the hole transport material 292 can be alcohol-soluble, to assist in its application along with the crosslinking polymer in solution form. In some embodiments, the hole transport material can be an alcohol soluble polyhydroxy diaryl amine small molecule hole transport material having at least two hydroxy functional groups. In various embodiments, small molecule hole transport material 292 can be represented by the following formula:

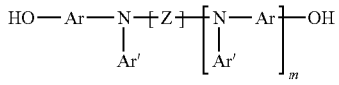

wherein:

m is 0 or 1,

Z is selected from the group consisting of:

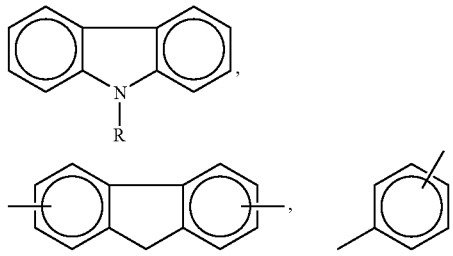

-continued

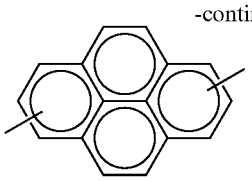

and —Ar—(X)$_n$—Ar— n is 0 or 1,

Ar is selected from the group consisting of:

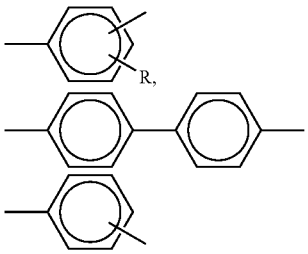

and

R is selected from the group consisting of —$CH_3$, —$C_2H_5$, —$C_3H_7$, and —$C_4H_9$, Ar' is selected from the group consisting of:

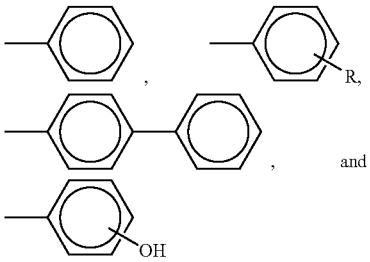

and

X is selected from the group consisting of:

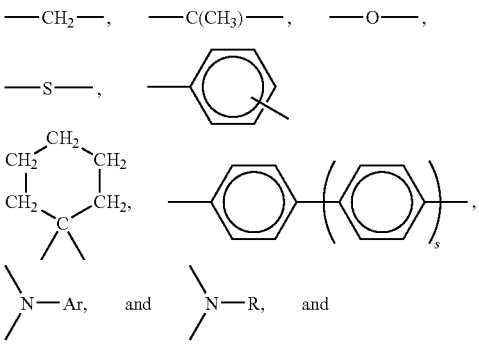

s is 0, 1 or 2, the dihydroxy arylamine compound can be free of any direct conjugation between the —OH groups and the nearest nitrogen atom through one or more aromatic rings.

The expression "direct conjugation" is defined as the presence of a segment, having the formula —(C═C)$_n$—C═C— in one or more aromatic rings directly between an —OH group and the nearest nitrogen atom. Examples of direct conjugation between the —OH groups and the nearest nitrogen atom through one or more aromatic rings include a compound containing a phenylene group having an —OH group in the ortho or para position (or 2 or 4 position) on the phenylene group relative to a nitrogen atom attached to the phenylene group or a compound containing a polyphenylene group having an —OH group in the ortho or para position on the terminal phenylene group relative to a nitrogen atom attached to an associated phenylene group.

Typical polyhydroxy arylamine compounds utilized in the overcoat of embodiments include, for example: N,N'-diphenyl-N,N'-bis(3-hydroxyphenyl)-[1,1'-biphenyl]-4,4'-diamine; N,N,N',N',-tetra(3-hydroxyphenyl)-[1,1'-biphenyl]-4,4'-diamine; N,N-di(3-hydroxyphenyl)-m-toluidine; 1,1-bis-[4-(di-N,N-m-hydroxyphenyl)-aminophenyl]-cyclohexane; 1,1-bis[4-(N-m-hydroxyphenyl)-4-(N-phenyl)-aminophenyl]-cyclohexane; bis-(N-(3-hydroxyphenyl)-N-phenyl-4-aminophenyl)-methane; bis[(N-(3-hydroxyphenyl)-N-phenyl)-4-aminophenyl]-isopropylidene; N,N'-diphenyl-N,N'-bis(3-hydroxyphenyl)-[1,1'4',1"-terphenyl]-4,4"-diamine; 9-ethyl-3,6-bis[N-phenyl-N-3(3-hydroxyphenyl)-amino]-carbazole; 2,7-bis[N,N-di(3-hydroxyphenyl)-amino]-fluorene; 1,6-bis[N,N-di(3-hydroxyphenyl)-amino]-pyrene; 1,4-bis[N-phenyl-N-(3-hydroxyphenyl)]-phenylenediamine.

In some embodiments, the hole transport material 292 can be a dihydroxy terphenyl, for example a dihydroxy terphenyl diamine. In various embodiments, the terphenyl charge transporting molecule can be represented by the following formula:

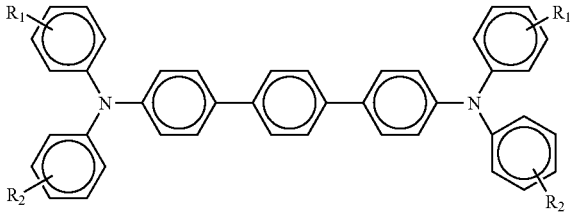

where each $R_1$ is —OH, $R_2$ is alkyl (—$C_nH_{2n+1}$) where n is from 2 to about 10 such as from 2 to about 5 or from about 2 to about 6, aralkyl, and aryl groups, the aralkyl and aryl groups having, for example, from about 5 to about 30, such as about 6 to about 20, carbon atoms. Suitable examples of aralkyl groups include, for example, —$C_nH_{2n}$-phenyl groups where n is from about 1 to about 5 or from about 1 to about 10. Suitable examples of aryl groups include, for example, phenyl, naphthyl, biphenyl, and the like. In one embodiment, for example, where $R_1$ is —OH and each $R_2$ is n-butyl, the resultant compound is N,N'-bis[4-n-butylphenyl]-N,N'-di[3-hydroxyphenyl]-terphenyl-diamine. In various embodiments, the hole transport material 292 can be soluble in the selected solvent used in forming the overcoat layer 290.

Any suitable secondary or tertiary alcohol solvent can be employed for the film forming crosslinking polymer. Typical alcohol solvents include, but are not limited to, for example, tert-butanol, sec-butanol, 2-propanol, 1-methoxy-2-propanol, and the like and mixtures thereof. Other suitable co-solvents that can be used in forming the overcoat layer include, but are not limited to, for example, tetrahydrofuran, monochlorobenzene, and mixtures thereof. These co-solvents can be used in addition to the above alcohol solvents, or they can be omitted entirely. However, in some embodiments, it is preferred that higher boiling alcohol solvents be avoided, as they can interfere with the desired cross-linking reaction.

All the components including crosslinking polymer, hole transport material 292, crosslinking agent, acid catalyst, and blocking agent, utilized in the overcoat solution of this disclosure can be soluble in the solvents or solvents employed for the overcoating. When at least one component in the overcoating mixture is not soluble in the solvent utilized, phase separation can occur, which can adversely affect the transparency of the overcoat layer 290 and electrical performance of the final imaging member.

The thickness of the overcoat layer 290 can depend upon the abrasiveness of the charging (e.g., bias charging roll), cleaning (e.g., blade or web), development (e.g., brush), transfer (e.g., bias transfer roll), etc., in the system employed and can range from about 1 or about 2 microns up to about 10 or about 15 microns or more. In various embodiments, the thickness of the overcoat layer 290 can be from about 1 micrometer to about 5 micrometers. Typical application techniques for applying overcoat layer 290 over the photoconductive layer 130 can include spraying, dip coating, roll coating, wire wound rod coating, and the like. Drying of the deposited overcoat layer 290 can be effected by any suitable conventional technique such as oven drying, infrared radiation drying, air drying and the like. The dried overcoat layer 290 of this disclosure should transport charges during imaging and should not have too high a free carrier concentration. Free carrier concentration in the overcoat increases the dark decay. For example, the dark decay of the overcoat layer 290 can be about the same as that of the uncoated photoconductive layer 130.

In the dried overcoat layer 290, the composition can include from about 0 to about 60 percent by weight hole transport material 292 and from about 100 to about 60 percent by weight film-forming cross-linkable polymer and crosslinking agent. For example, in some embodiments, the hole transport material 292 can be incorporated into the overcoat layer 290 in an amount of about 20 to about 50 percent by weight. As desired, the overcoat layer 290 can also include other materials, such as conductive fillers, abrasion resistant fillers, and the like, in any suitable and known amounts.

Also, included within the scope of the present disclosure are methods of imaging and printing with the imaging members illustrated herein. These methods generally involve the formation of an electrostatic latent image on the imaging member; followed by developing the image with a toner composition comprised, for example, of thermoplastic resin, colorant, such as pigment, charge additive, and surface additives, reference U.S. Pat. Nos. 4,560,635, 4,298,697 and 4,338,390, the disclosures of which are totally incorporated herein by reference; subsequently transferring the image to a suitable substrate; and permanently affixing the image thereto. The disclosure is not limited to use in electrophotographic copying systems, but can be used in any suitable liquid development printing systems, including ionographic systems as well as printing, copying, and other systems.

According to various embodiments, there is a method for producing an electrophotographic imaging member. The method can comprise providing an exposed receiving surface of an electrophotographic imaging member 200, wherein the electrophotographic imaging member 200 comprises a substrate 205 and an electrophotographic imaging layer 130. The method can also comprise forming an overcoat layer 290 comprising a hole transport material 292 and at least one of an acrylated polyol film forming resin and a polyester polyol film forming resin, wherein the overcoat layer 290 can provide at least one of solvent resistance and hydrocarbon resistance to the electrophotographic imaging layer 130. The film forming step can further include providing an overcoat coating solution comprising said hole transport material 292 and said film forming resin in a solvent system, applying the overcoat coating solution on the exposed receiving surface of the electrophotographic imaging member 200 and crosslinking the said film forming resin to form a cured polymeric film.

An example is set forth hereinbelow and is illustrative of different compositions and conditions that can be utilized in practicing the disclosure. All proportions are by weight unless otherwise indicated. It will be apparent, however, that the disclosure can be practiced with many types of compositions and can have many different uses in accordance with the disclosure above and as pointed out hereinafter.

EXAMPLES

Example 1

Preparation of Overcoat Coating Solution

An overcoat coating composition was formed containing 5 grams of JONCRYL® 587 (acrylated polyol from Johnson Polymers Inc.), 7 grams of CYMEL® 303 (commercial grade of hexamethoxymethylmelamine from Cytec Industries Inc.), 54 grams of DOWANOL® PM (1-methoxy-2-propanol from Dow Chemical Company), 0.72 grams Silclean 3700 from BYK-Chemie USA, and 6 grams N,N'-diphenyl-N,N'-di[3-hydroxyphenyl]-terphenyl-diamine (DHTBD) in a 1 ounce bottle. The components were mixed and the temperature was raised to about 40° C. until a complete solution was achieved. Next, 3.6 grams of p-toluenesulfonic acid as a catalyst was added.

Example 2

Preparation of an Overcoated Drum Photoreceptor

An aluminum drum having a diameter of about 3 cm and a length of about 31 cm, with a conductive layer 110 and an electrophotographic imaging layer 130 over the conductive layer 110 was overcoated with the overcoat coating solution from Example 1. The overcoat coating solution was applied using a Tsukiage dip coating apparatus and dried at 125° C. for 40 minutes. The result was a drum photoreceptor having an overcoat layer thickness of about 3.0 microns.

Example 3

Preparation of Overcoat Coating Solution

An overcoat coating solution was formed by adding 10 parts of POLYCHEM® 7558-B-60 (acrylated polyol with OH number=1200 from OPC Polymers), 4 parts of PPG 2K (polypropyleneglycol with a molecular weight of 2000 from Sigma-Aldrich), 6 parts of CYMEL® 1130 (methylated, butylated melamine-formaldehyde from Cytec Industries Inc.), 8 parts of N,N'-diphenyl-N,N'-[3-hydroxyphenyl]-terphenyl-diamine (DHTBD), 1.5 parts of Silclean 3700 from BYK-Chemie USA and 5.5 parts of 8% p-toluenesulfonic acid in 60 grams of DOWANOL® PM (1-methoxy-2-propanol from the Dow Chemical Company).

Example 4

Preparation of an Overcoated Belt Photoreceptor

A belt photoreceptor with a conductive layer 110 and an electrophotographic imaging layer 130 over the conductive layer 110 was coated with the overcoat coating solution from Example 3. The overcoat coating solution was applied by hand on the belt photoreceptor using a ⅛ mil Bird bar to create an overcoat layer of about 2 micron to about 5 micron in thickness. The wet film was dried for 2 minutes in a forced air oven at 125° C.

Testing of Photoreceptor for Crystallization of Charge Transport Material by Liquid Ink Each of the photoreceptors (drum and belt) was exposed to ISOPAR® M (an isoparaffinic fluid) by placing a pad of cotton on the photoreceptor. The cotton pad was saturated with the ISOPAR® M and allowed to set overnight. Photoreceptors comprising the overcoat layer showed no sign of crystallization after prolonged (one month) exposure to ISOPAR® M.

While the disclosure has been illustrated with respect to one or more implementations, alterations and/or modifications can be made to the illustrated examples without departing from the spirit and scope of the appended claims. In addition, while a particular feature of the disclosure may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising."

Other embodiments of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

What is claimed is:

1. An electrophotographic imaging member comprising:

a substrate;

an electrophotographic imaging layer; and an overcoat layer comprising a crosslinked polymer and a hole transport material, wherein the hole transport material is a polyhydroxy diaryl amine having at least two hydroxy functional groups, and wherein the overcoat layer provides at least one of solvent resistance and hydrocarbon resistance to the electrophotographic imaging layer in a liguid ink image development system.

2. The electrophotographic imaging member according to claim 1, wherein the overcoat layer provides liquid ink resistance to the electrophotographic imaging layer in a liquid ink image development system.

3. The electrophotographic imaging member according to claim 1, wherein the crosslinked polymer comprises at least one of polyester polyol and acrylated polyol.

4. The electrophotographic imaging member according to claim 3, wherein the polyester polyol and acrylated polyol have a hydroxyl number from about 10 to about 10,000.

5. The electrophotographic imaging member according to claim 3, wherein the polyester polyol is a branched polyester polyol.

6. The electrophotographic imaging member according to claim 3, wherein the polyester polyol is represented by the formula:

(—CH2-Ra-CH2)m-(—CO2-Rb-CO2-)n-(—CH2-Rc-CH2)p-(—CO2-Rd-CO2-)q where Ra and Rc independently represent linear alkyl groups or branched alkyl groups, the alkyl groups comprising from about 1 to about 20 carbon atoms; Rb and Rd independently represent alkyl groups derived from the polycarboxylic acids, the alkyl groups comprising from about 1 to about 20 carbon atoms; and m, n, p, and q represent mole fractions of from ato 1, wherein n+m+p+q=1.

7. The electrophotographic imaging member according to claim 3, wherein the acrylated polyol is a branched acrylated polyol.

8. The electrophotographic imaging member according to claim 3, wherein the acrylated polyol is represented by the formula:

(—CH2-Ra-CH2)m-(—CO—Rb-CO—)n-(—CH2-Rc-CH2)p-(—CO-Rd-CO—)q where Ra and Rc independently represent linear alkyl or alkoxy groups or branched alkyl or alkoxy groups, the alkyl and alkoxy groups having from about 1 to about 20 carbon atoms; Rb and Rd independently represent alkyl or alkoxy groups, the alkyl and alkoxy groups having from about 1 to about 20 carbon atoms; and m, n, p, and q represent mole fractions of from 0 to 1, such that n+m+p+q=1.

9. The electrophotographic imaging member according to claim 1, wherein the overcoat layer comprises from about 0 to about 60 percent by weight hole transport material and from about 100 to about 60 percent by weight crosslinked polymer and crosslinking agent.

10. The electrophotographic imaging member according to claim 1, wherein the overcoat layer has a thickness from about 0.1 microns to about 8 microns.

11. The electrophotographic imaging member according to claim 1, wherein the overcoat layer further comprises a crosslinking agent.

12. The electrophotographic imaging member according to claim 1, wherein the crosslinking agent is a methylated, butylated melamine formaldehyde.

13. The electrophotographic imaging member according to claim 1, wherein the overcoat layer further comprises an acid catalyst.

14. The electrophotographic imaging member according to claim 13, wherein the acid catalyst is p-toluenesulfonic acid.

15. A method for producing an electrophotographic imaging member, the method comprising:

providing a receiving surface of an electrophotographic imaging member, wherein the electrophotographic imaging member comprises a substrate and an electrophotographic imaging layer;

forming an overcoat layer comprising a hole transport material and at least one of an acrylated polyol film forming resin and a polyester polyol film forming resin;

wherein the hole transport material is a polyhydroxy diaryl amine having at least two hydroxy functional groups, and wherein the overcoat layer provides at least one of solvent resistance and hydrocarbon resistance to the electrophotographic imaging layer in a liquid ink imaqe development system.

16. The method of claim 15, wherein the forming step comprises:

providing an overcoat coating solution comprising said film forming resin and said hole transport material in a solvent system;

applying the overcoat coating solution on the receiving surface of the electrophotographic imaging member; and crosslinking the said film forming resin to form a cured polymeric film.

17. The method of claim 16, wherein the overcoat coating solution further comprises at least one of a crosslinking agent and a catalyst.

18. An electrophotographic image development device, comprising an electrophotographic imaging member comprising:

a substrate;

an electrophotographic imaging layer; and an overcoat layer, said overcoat layer comprising a crosslinked polymer and a hole transport material, wherein the hole transport material is a polyhydroxy diaryl amine having at least two hydroxy functional groups, and wherein the overcoat layer provides at least one of solvent resistance and hydrocarbon resistance to the electrophotographic imaging layer in a liquid ink image development system.

19. The electrophotographic image development device of claim 18, further comprising a liquid ink image development system, wherein the overcoat layer provides liquid ink resistance to the electrophotographic imaging layer.

* * * * *